United States Patent [19]

Kardosh

[11] Patent Number: 4,792,168

[45] Date of Patent: Dec. 20, 1988

[54] PATIO DOOR BLOCK

[76] Inventor: Robert Kardosh, 3 Ardmay Crescent Guelph, Canada NIE 4L4

[21] Appl. No.: 43,253

[22] Filed: Apr. 24, 1987

[51] Int. Cl.[4] ..... E05C 19/18

[52] U.S. Cl. ..... 292/288; 292/DIG. 46; 292/339; 403/108; 403/379

[58] Field of Search ..... 292/288, DIG. 46, 339, 292/263; 403/104, 107, 108, 109, 377, 378, 379; 49/449, 450

[56] References Cited

U.S. PATENT DOCUMENTS

| | | | |
|---|---|---|---|
| 864,329 | 8/1907 | North | 403/109 |
| 1,601,524 | 9/1926 | Gibbons | 292/262 |
| 2,594,605 | 4/1952 | Zoppelt | 403/108 |
| 2,687,268 | 8/1954 | Hawes | 403/108 |
| 2,912,268 | 11/1959 | Markovich | 292/262 |
| 2,973,217 | 2/1961 | Gregoire | 292/339 |
| 3,085,300 | 4/1963 | Carlston | 49/450 |
| 3,117,689 | 1/1964 | Dedic, Sr. | 292/262 |
| 3,420,001 | 1/1969 | Raymon | 49/450 |
| 3,471,189 | 10/1969 | Ness | 292/DIG. 46 |
| 3,486,781 | 12/1969 | Crum | 292/262 |
| 3,554,592 | 1/1971 | Katz | 292/263 |
| 3,615,114 | 10/1971 | Harris | 292/288 |
| 3,640,559 | 2/1972 | Royer | 292/DIG. 46 |
| 3,698,754 | 10/1972 | Means | 292/DIG. 46 |
| 3,797,005 | 3/1974 | Schwarz | 292/262 |
| 3,820,285 | 6/1974 | Shiffler et al. | 49/450 |
| 3,942,904 | 3/1976 | Morris | 403/379 |
| 3,992,815 | 11/1976 | Potter | 292/263 |
| 4,045,982 | 9/1977 | Gorton et al. | 292/DIG. 46 |
| 4,073,522 | 2/1978 | Tierney | 292/288 |
| 4,148,508 | 4/1979 | Adair | 292/DIG. 46 |
| 4,171,835 | 10/1979 | Conley et al. | 292/DIG. 46 |
| 4,190,271 | 2/1980 | Hawkins | 292/DIG. 46 |
| 4,295,676 | 10/1981 | Smith | 292/DIG. 46 |
| 4,368,906 | 1/1983 | Briggs | 292/305 |
| 4,461,502 | 7/1984 | Burgess | 292/DIG. 46 |
| 4,462,625 | 7/1984 | Barnhill | 403/377 |
| 4,570,985 | 2/1986 | Waldo et al. | 292/DIG. 46 |

FOREIGN PATENT DOCUMENTS

| | | | |
|---|---|---|---|
| 888312 | 7/1953 | Fed. Rep. of Germany | 403/108 |
| 909527 | 9/1944 | France | 403/108 |
| 1421660 | 12/1964 | France | 403/108 |
| 175936 | 3/1935 | Switzerland | 403/108 |
| 1234390 | 6/1971 | United Kingdom | 403/108 |

*Primary Examiner*—Richard E. Moore
*Assistant Examiner*—Eric K. Nicholson
*Attorney, Agent, or Firm*—Ridout & Maybee

[57] ABSTRACT

An adjustable safety block assembly is disclosed which can be used to traverse an opening for a sliding door in order to block it. The assembly consists of inner and outer tubular members which can be telescoped together. One of the tubular members has a series of axially extending rows of holes spaced at even intervals, and staggered around the radius of the two. The other tubular member has groups of evenly axially spaced circumferentially distributed holes radially arranged. The tubular members may be telescoped until the desired length is achieved, and then holes of the inner and outer tubular members aligned so that locking means can be inserted through the aligned holes to fix the tubular members in relative position, to form a rigid bar. Thus, the safety block is easily adjustable to accommodate any patio door widths, and may be disassembled for storage and travel.

5 Claims, 2 Drawing Sheets

PATIO DOOR BLOCK

BACKGROUND OF THE INVENTION

The present invention relates to an adjustable safety block which can be used for blocking the opening of a sliding door, such as a patio door. The invention also relates to a method for assembling tee safety block to a desired length for traversing the width of the opening of any size of sliding doors.

Sliding patio doors are generally constructed with light aluminum frames so that the door may be easily opened and closed without requiring substantial physical strength. One disadvantage of such a construction is that repeated rough handling often destroys the locking mechanism of the door through deformation or severing of the portion of the frame intended to be engaged by the locking bolt.

Repairing the locking mechanism is often costly, since replacement of the entire door frame may be required.

Also, light construction of the door frame and the resultant ease with which a locking mechanism can be destroyed, means that sliding patio doors, even when in good order, are a safety risk from intruders.

It is therefore the object of the present invention to provide a safety block of adjustable length which can be wedged before the path of a sliding door to prevent opening.

It is a further object of this invention to provide a safety block for a sliding door which is easily assemblable and disassemblable, and therefore particularly useful for travellers to secure sliding balcony doors of hotels and resorts.

SUMMARY OF THE INVENTION

According to the invention, an adjustable safety block assembly for traversing an opening for a sliding door is provided, which consists of inner and outer tubular members, the inner tubular member being receivable in the outer tubular member in sliding telescopic arrangement. One of the tubular members has defined through its tube wall an axially-extending row of holes spaced at even intervals. The other tubular member has defined through its tube wall, within the spacing of one of the even intervals, a group of evenly axially-spaced circumferentially-distributed holes. At least one hole in each of the inner and outer tubular members may be aligned within a range of telescopic positions of the tubes. Locking means are also provided which are insertable through aligned hole of the inner and outer tubular members for retaining the inner tubular member at a fixed position inside the outer tubular member, in order to form a rigid bar.

Preferably, each tubular member has corresponding holes on both sides, providing pairs of holes in register, so that a pin or other locking means can be passed through both members and secured at each end on the outer side of the outer member.

Preferably, said one tubular member has a plurality of rows of holes circumferentially spaced around it, the holes in each row being axially staggered with respect to the holes in the or each adjacent row. This makes the bar more finely adjustable in length without substantially weakening the bar structurally. A plurality of similarly arranged groups of holes are defined along the other tubular member, each group extending axially within the axial staggering between adjacent rows in said one member, and each group being spaced a distance equal to or an integral multiple of the interval between the holes of each row in said one tubular member. With this arrangement the bar can be finely adjusted to fit varying opening widths, and a plurality of aligned pairs of holes will be presented through which locking means may be inserted.

Also provided according to the invention is a method for assembling a safety block having inner and outer tubular members. One tubular member is provided with rows of evenly-spaced holes staggered around the perimeter of that one tubular member providing pairs of holes in register. In the case of the other tubular member, a plurality of groups of circumferentially-distributed holes are defined along its length. Each group of holes is defined within the spacing of one of the even intervals, and corresponds with a group of holes formed on the opposite side of the tubular member forming pairs of holes in register. The method comprises the steps of telescoping the inner tubular member inside the outer tubular member until the safety block is of a predetermined length; rotating the one tubular member independently of the other tubular member until at least one pair of holes in register formed through the inner tubular member is in partial alignment with at least one pair of holes in register formed through the outer tubular member; rotating the other tubular member independently of the one tubular member until at least one pair of holes in register formed through the outer tubular member is in substantially complete alignment with at least one pair of holes in register formed through the inner tubular member; and securing the inner and outer tubular members together to prevent further movement therebetween.

Preferably, each tubular member is held stationary during rotation of the other.

DETAILED DESCRIPTION OF THE PREFERRED EMBODIMENTS

Figure 1:
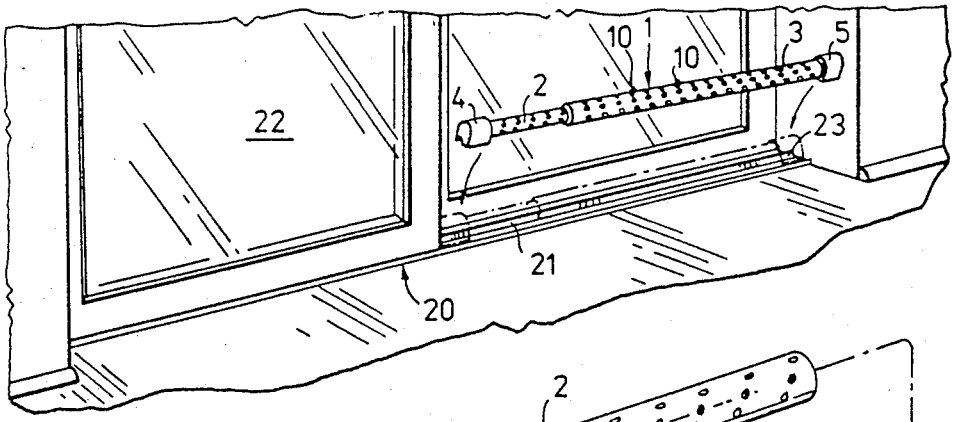
FIG. 1 is a perspective view of an assembled safety block being wedged into the opening path of a sliding door.
Figure 2:
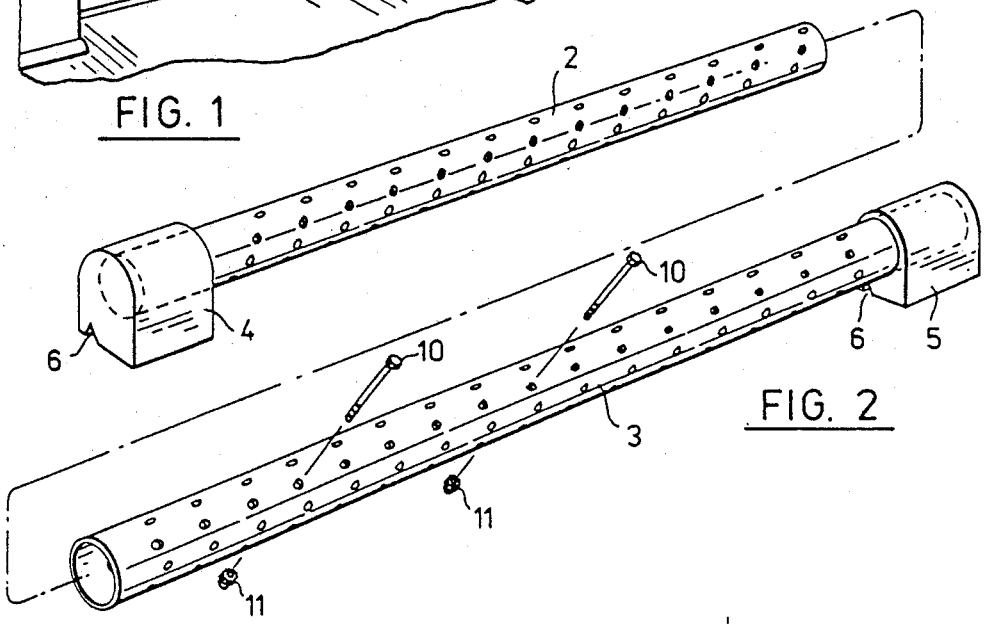
FIG. 2 is a perspective view of the disassembled elements of the safety block.

As show in FIG. 2, a safety block 1, according to the invention, is constructed of two tubular members, an inner tubular member 2 an outer tubular member 3. As can be seen from FIG. 1, the inner tubular member 2 may be inserted into the outer tubular member 3 in sliding telescopic arrangement.

Caps 4 and 5 are mounted over the respective free ends of the tubular members 2 and 3. Each cap is formed with a groove 6 extending the length of the cap bottom. Preferably the groove 6 is off-centre, and toward an opposite side on each cap, so that the caps present the grooves in aligned mirror image when facing each other mounted at opposite ends of the assembled safety block 1.

After the inner tubular member 2 has been inserted into the outer tubular member 3, and in order to adjust the length of the safety block 1 to fit a particular sliding door assembly 20, the inner tubular member 2 is telescopically slid in and out of the outer tubular member 3 until the desired length is achieved. The desired length should be sufficient to horizontally traverse the opening path 21 for the sliding door 22.

Preferably, the tubular members 2 and 3 will be of sufficiently light weight that the user will be able to adjust the length of the safety block 1 while holding it across the opening path 21.

Figure 3:
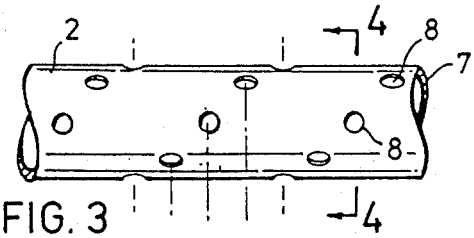
FIGS. 3 and 5 are perspective views of a section of the inner and outer tubular member, respectively.
Figure 4:
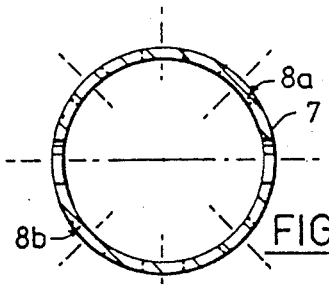
FIGS. 4 and 6 are cross-sectional views of the tubular members of FIGS. 3 and 5 taken along lines 4—4 and 6—6 respectively.

As shown in FIG. 3, the inner tubular member is provided with a plurality of staggered rows of holes 8 formed through the tube wall 7, and as can be seen from FIG. 4, each hole 8*a* is in register with a second paired hole 8*b* formed through the opposite side of the tube wall 7 at a 180° angle.

Figure 5:
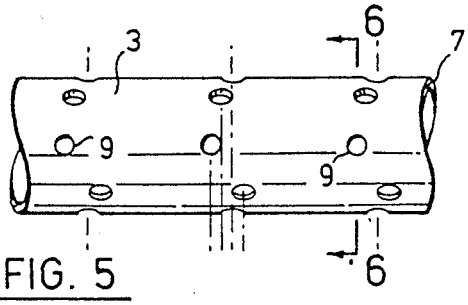

Similarly, FIG. 5 illustrates that the outer tubular member is provided with groups of holes 9. Within each group, the holes 9 are circumferentially-distributed within the same interval as has been used for the spacing of holes 8 of the inner tubular member. The net effect is also of staggered rows of holes 9 on the outer tubular member.

Figure 6:
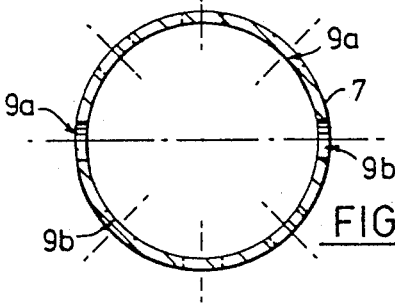

FIG. 6 illustrates that each hole 9*a* on the outer tubular member is in register with a second paired hole 9*b* formed through the opposite side of the tube wall 7 at a 180° angle.

FIG. 3 illustrates the preferred staggering of rows of holes 8 in the inner tubular member 2. The holes 8 are staggered at intervals of ¼ of an inch.

Due to the grouping of holes 9, the preferred staggering of rows of holes 9 in the outer tubular member 3, as illustrated in FIG. 5, is in a zig-zag pattern. As can be seen, each hole 9 is not spaced an even interval from its neighbouring holes, but are staggered to achieve an overall radial spacing at intervals of 1/16th of an inch, within each group of holes 9.

It should be noted that as the diameter and/or wall thickness of the tubes is reduced, it may be preferable to locate the holes 8 spaced ¼ inch apart in the outer tube 3 and the holes 9 spaced 1/16 inch apart in the inner tube 2.

In order to lock the inner and outer tubular members 2 and 3 together, to form a rigid safety bar at the desired length, it is proposed that bolts 10 be passed through aligned pairs of holes in register of the inner and outer tubular members, and be secured by threading nuts 11 onto the ends of bolts 10 protruding from the far side of the outer tubular member 3. A stove-pipe bolt and acorn nut are preferred, because their rounded ends provide a safety feature in the case of falls against the bar or curtain fabric catching and tearing.

Although one bolt 10 would be sufficient to lock the inner and outer tubular members together, it is preferred that at least two bolts be utilized, if possible, for longitudinal load distribution, and to prevent failure of the bar in the case of a flaw in one of the tubular members at the locking point of a single bolt.

Figure 7:
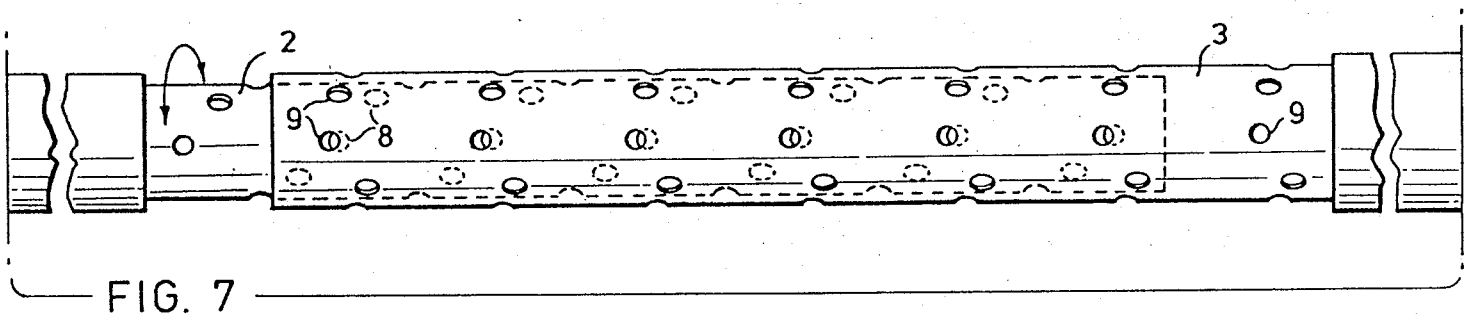
FIGS. 7 and 8 are time-sequential views illustrating relative adjustment of the inner and outer tubular members preparatory to locking the same, according to the method of assembling the safety block of the invention.
Figure 8:
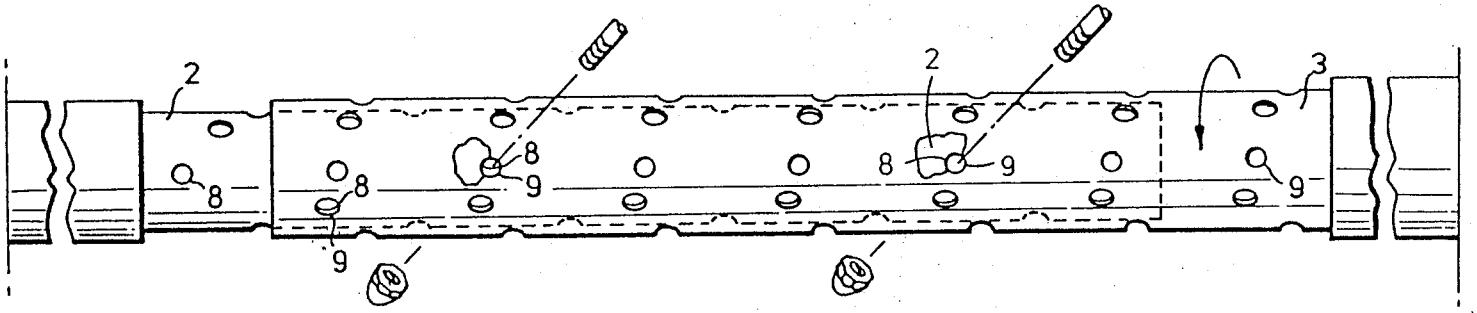

In order to align pairs of holes in register of the inner and outer tubular members 2 and 3, the method illustrated in FIGS. 7 and 8 is proposed.

As shown in FIG. 7, the user should first rotate the inner tubular member 2, holding the outer tubular member 3 stationary, until a partial alignment of at least one pair of holes 8 of the inner tubular member 2 with a pair of holes 9 of the outer tubular member 3 is observed.

For fine tuning, to achieve a more complete alignment, the outer tubular member 3 is then rotated while the inner tubular member 2 is held stationary, until a substantially perfect alignment of at least one pair of holes of each tubular member is observed, as shown in FIG. 8.

Because the staggering of holes 8 of the inner tubular member 2 in the preferred embodiment is an even multiple of the radial spacing of holes 9 of the outer tubular member 3, all pairs of holes in one end to end horizontal line should align simultaneously, thus allowing for use of more than one bolt 10 and nut 11 to lock the tubular members in their relative positions.

Once the safety block 1 is assembled and secured, it is wedged into the opening path 21 of the sliding door assembly 20, at floor level. The aligned grooves 6 in each of the caps 4 and 5 are placed over a lip 23 of the sliding door track, to limit lateral displacement of the safety block 1 from the opening path 21.

Where the groove 6 is off-centred on the caps 4 and 5, the safety block 1 is preferably oriented so that the grooved side of the caps straddles the window side of the lip 23, the heavier ungrooved side of the caps providing increased stability for maintaining the safety block 1 in position.

Preferably, the tubular members 2 and 3 are manufactured of a light-weight yet stress-resistant rigid material such as steel, aluminum or plastic.

The caps 4 and 5 may be manufactured of a heavy natural or synthetic rubber, for improved lip-engaging grip, and metal washers may be inserted in the caps prior to mounting on the ends of the tubular members. These washers will abut the ends of the tubular members to provide improved load-bearing distribution.

The safety bar is intended for disassembly and portability. Therefore, the tubular members may be manufactured of a length to fit diagonally in a standard suitcase. The resulting safety block would then be usable for any sliding door up to approximately three feet in width (six foot width for the total sliding door assembly). This represents about 95% of the sliding glass door market. For larger sizes, special longer tubular members could be constructed, or a sleeve, up to about one foot in length, could be added to the outer tubular member 3 or the inner tubular member 2.

I claim:

1. An adjustable safety block assembly for traversing an opening for a sliding door, comprising:

a first tubular member having a first series of circumferentially distributed axially extending rows of holes circumscribing its tube wall, the hole of the first series being spaced in uniform intervals from axially adjacent holes and being axially staggered in uniform intervals relative to circumferentially adjacent holes;

a second tubular member engaging the first tubular member in sliding telescopic relation and having a second series of circumferentially evenly distributed holes, the holes of the second series being axially staggered relative to circumferentially adjacent holes in uniform intervals equal to the fraction obtained by dividing the length of the interval of axial staggering of holes in the first series by the number of holes in the second series;

locking means inserted through aligned holes of the first and second series respectively for retaining the tubular members in mutually fixed relation to form a rigid bar; and caps mounted on opposite ends of the rigid bar, each cap being provided with a groove extending axially relative to the tubular members for engaging a lip of a runner of a sliding door for limiting lateral displacement of the safety block from the opening for the sliding door.

2. A method for assembling a safety block having a first tubular member having a first series of circumferentially distributed axially extending rows of holes circumscribing its tube wall, the holes of the first series being spaced in uniform intervals from axially adjacent holes and being axially staggered in uniform intervals relative to circumferentially adjacent holes, and a second tubular member adapted to engage the first tubular member in sliding telescopic relation and having a second series of circumferentially evenly distributed holes, the holes of the second series being axially staggered relative to circumferentially adjacent holes in uniform intervals equal to the fraction obtained by dividing the length of the interval of axial staggering of holes of the first series by the number of holes in the second series, comprising the steps of:

telescoping one tubular member inside the other tubular member until the safety block is of a desired length;

rotating the first tubular member independently of the second tubular meeker until at least one hole of the first series is in partial alignment with at least one hole of the second series;

rotating the second tubular member independently of the first tubular member until at least one hole of the first series is in substantially complete alignment with at least one hole of the second series; and inserting locking means through substantially completely aligned holes of the first and second series to retain the tubular members in mutually fixed relation.

3. A method for assembling a safety block, according to claim 2, further comprising the step of mounting caps having a grip feature extending axially relative to the tubular members to each free end of the first and second tubular members.

4. A method for assembling a safety block, according to claim 2, wherein the second tubular member is held stationary during rotation of the first tubular member, and the first tubular member is held stationary during subsequent rotation of the second tubular member.

5. A method for assembling a safety block, according to claim 2, wherein the step of securing the first and second tubular members together comprises inserting a pin through aligned holes and securing the pin against removal.

* * * * *